United States Patent [19]

Tokuno

[11] 4,266,998

[45] May 12, 1981

[54] METHOD FOR PRODUCING DOUBLE-FACED CORRUGATED BOARDS

[75] Inventor: Masateru Tokuno, Nishinomiya, Japan

[73] Assignee: Rengo Co., Ltd., Osaka, Japan

[21] Appl. No.: 144,308

[22] Filed: Apr. 28, 1980

[30] Foreign Application Priority Data

| | | | |
|---|---|---|---|
| May 2, 1979 | [JP] | Japan | 54-54292 |
| Sep. 17, 1979 | [JP] | Japan | 54-119899 |
| Mar. 15, 1980 | [JP] | Japan | 55-33173 |

[51] Int. Cl.[3] ..... B31F 5/00

[52] U.S. Cl. ..... 156/159; 156/205; 156/470

[58] Field of Search ..... 156/205–208, 156/210, 470–473, 462, 157–159, 502, 504

[56] References Cited

U.S. PATENT DOCUMENTS

| | | | |
|---|---|---|---|
| 1,914,071 | 6/1933 | Bowersock et al. | 156/473 |
| 2,289,909 | 6/1942 | Greenwood | 156/472 |

*Primary Examiner*—David A. Simmons

*Attorney, Agent, or Firm*—Norris & Bateman

[57] ABSTRACT

This method is a method producing double-faced corrugated boards which includes methods for changing single-faced corrugated boards. The methods comprise the steps of cutting a single-faced corrugated board which is fed from a single facer onto a bridge and delivered from the bridge into a double facer at said bridge or before it; and splicing the tailing edge of the board with the leading edge of another single-faced corrugated board which is fed from another single facer onto said bridge.

5 Claims, 4 Drawing Figures

METHOD FOR PRODUCING DOUBLE-FACED CORRUGATED BOARDS

This invention relates to a method for producing double-faced corrugated boards. More particularly, the present invention relates to an improved method for producing double-faced corrugated boards, which is improved as to how to change single-faced corrugated boards supplied to a double facer and how to remove defective portions of the single-faced corrugated boards.

Conventionally, the change of single-faced corrugated boards during the production of double-faced corrugated boards is carried out by cutting a single-faced corrugated board, for example an A-flute, which is fed from a glue machine to a double facer, at a position where it leaves the glue machine, and by inserting into the double facer the leading edge of another single-faced corrugated board, for example a B-flute, which is waiting at a position where it has passed through another glue machine. Accordingly, this method involves a serious disadvantage in that processes subsequent to the double facer must be stopped altogether or the speed of the processes must be drastically lowered, until the change of the single-faced corrugated boards, or flute-change, is completed. Further, this method also involves a dangerous work where operators have to insert the leading edge of a new single-faced corrugated board into a gap between a heating plate at the inlet of the double facer and a cotton belt. Furthermore, the stoppage of the abovementioned processes or the drastically lowered speed leads various disadvantages such as over-drying or warp, because the single-faced corrugated board to be delivered to the double facer stays on the heating plate for a period longer than a predetermined time.

Next, if the single-faced corrugated board to be delivered to the double facer includes any defective portions which originate in inferior splicing between mediums or between liner papers, inferior bonding between medium and liner paper and the like, there occur serious problems such as breakage of the board, jam-up and so forth, thereby inviting a loss of the product and a remarkable lowering of the production efficiency. Accordingly, if any defective portions are found on the single-faced corrugated board fed from the single facer onto a bridge, the feed of the board from the single facer and the delivery of the board to the double facer are conventionally interrupted or the delivering speed and the feeding speed are lowered every time the defective portion is found, so that the defective portion is manually cut off and dropped down from the bridge. This also results in the disadvantage with regard to the production of the double-faced corrugated boards and leads the dangerous work.

It is therefore an object of the present invention to provide a method for producing double-faced corrugated boards which makes it possible to perform the change, or flute change, of the single-faced corrugated boards and to cut off, or to remove, the defective portions, if any, of the board at a constant and high speed without stopping the production or lowering the splicing speed of the single-faced corrugated boards.

It is another object of the present invention to provide a method for producing a double-faced corrugated boards which enables operators to safely work during the flute change or the work for removing the defective portions.

These and other objects of the invention will become apparent from the following description to be taken in conjunction with the accompanying drawings.

To accomplish these objects, the present invention employs such an arrangement that both the flute change of single-faced corrugated boards and the removal of defective portions during the production of double-faced corrugated boards are carried out on bridges and the single-faced corrugated boards to be delivered to the double facer are allowed to be stored temporarily on the bridges. Portions of the single-faced corrugated boards which are stored temporarily are formed in a following manner. Namely, if the feeding speed of a single-faced corrugated board from a single facer onto a bridge is made higher than the delivery speed of the single-faced corrugated board from the bridge into a double facer, a portion of the single-faced corrugated board is allowed to stay on the bridge with the longitudinal length corresponding to the difference of these two speeds. The portion may be in such a quantity that both a cutting and a splicing for the flute change or the removal of a defective portion can be carried out sufficiently without lowering the delivery speed of the single-faced corrugated boards to the double facer. If the portion is stored sufficiently in the quantity, the feeding speed of the single-faced corrugated board from the single facer onto the bridge may be made equal to the delivery speed from the bridge to the double facer. If the portion of the board is stored more than necessary quantity, the feeding speed may be reduced to a level lower than the delivery speed.

Figure 1:
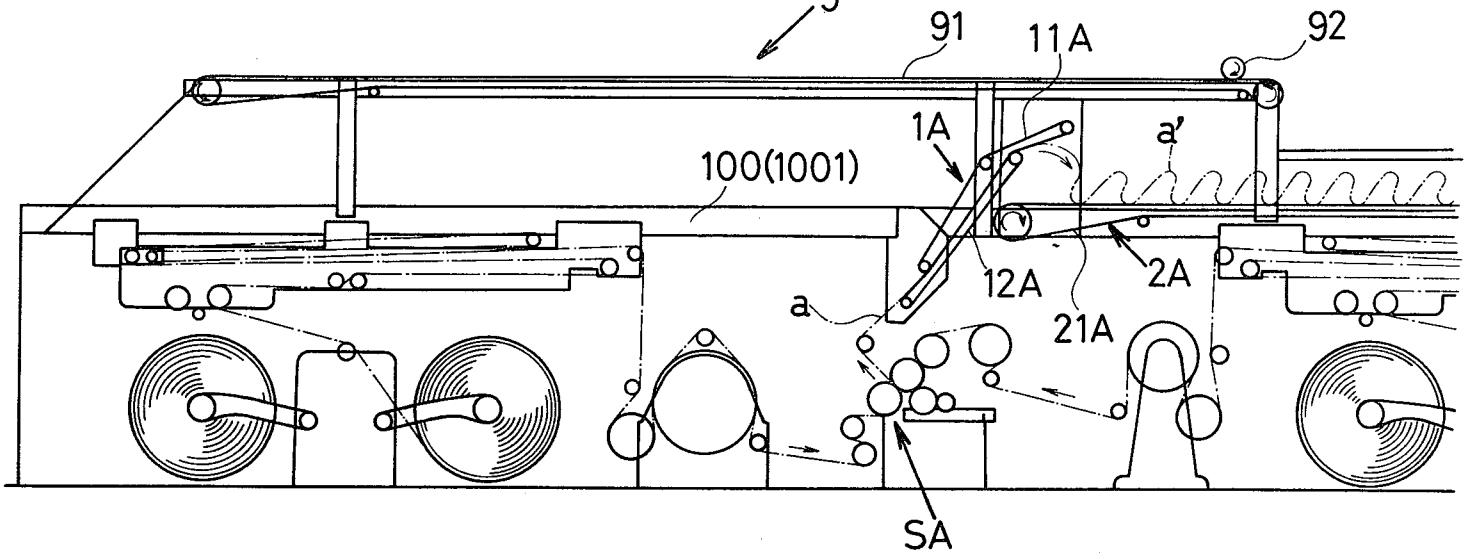
FIGS. 1, 2 and 3 are partial side views each showing one of three portions of an embodiment of the apparatus used for practising the method of the present invention. The apparatus is divided into a front portion, an intermediate portion and a rear portion and shown respectively.
Figure 2:
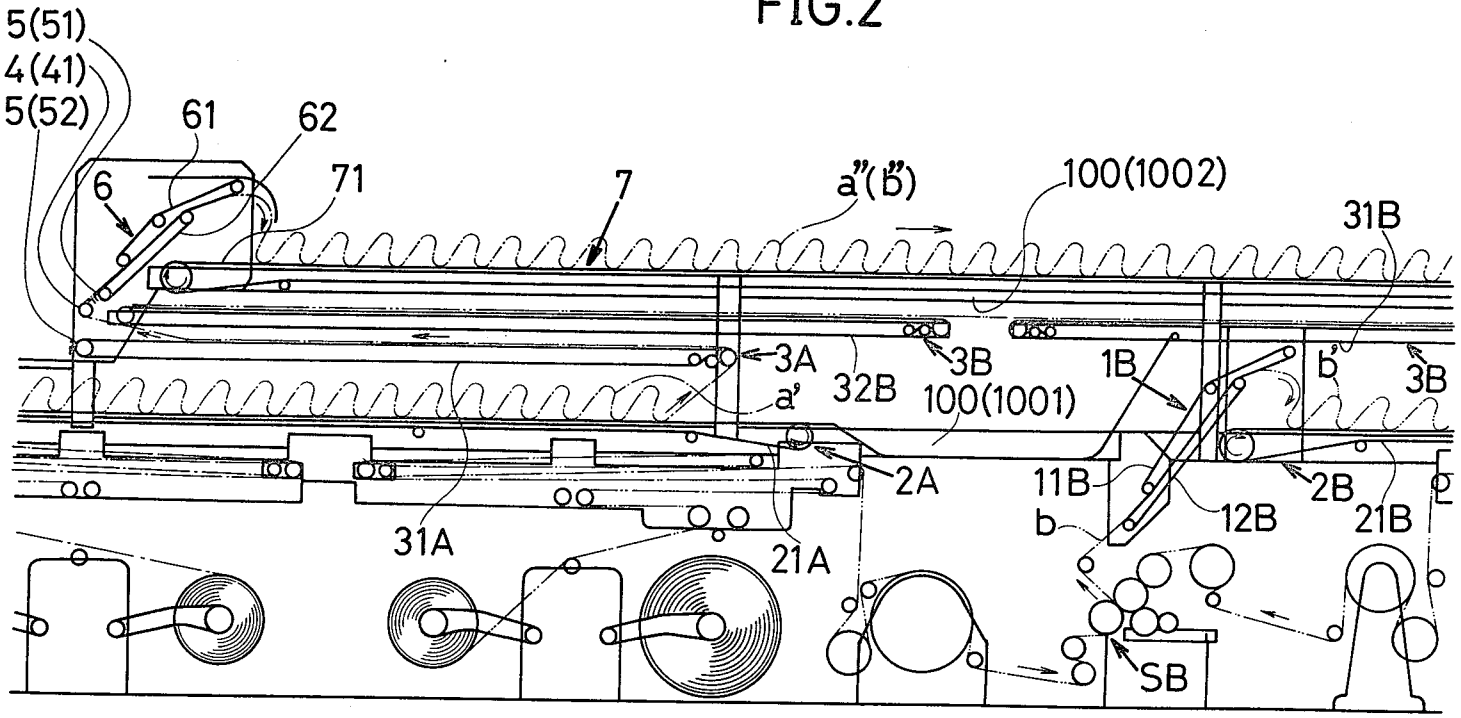
Figure 3:
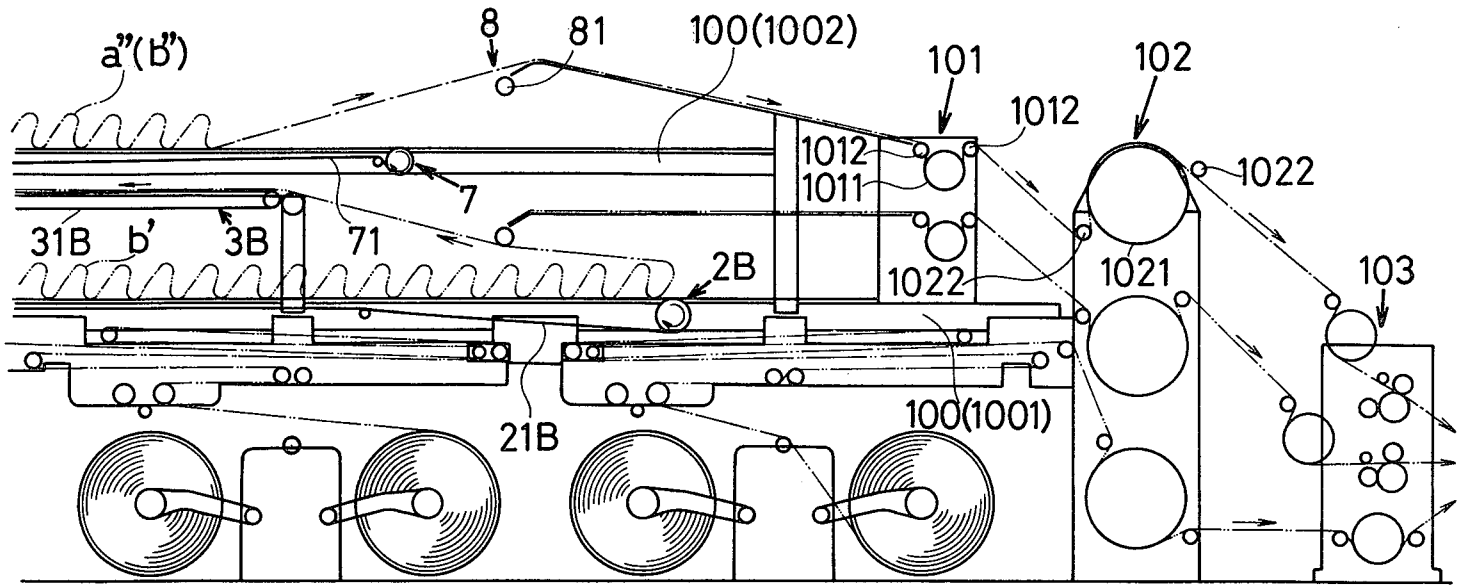

Hereinafter, the present invention will be explained in detail with reference to the apparatus shown in FIGS. 1, 2 and 3.

A single-faced corrugated board a produced by a single facer SA is fed by means of a vertical conveyor 1A, which comprises a pair of driven endless belt conveyors 11A and 12A disposed to be closely confronted each other, onto a bridge conveyor 2A which comprises an elongated, driven endless belt conveyor 21A and which is disposed at a lower part 1001 of a bridge 100. After passing through a feed conveyor 3A, which comprises a driven endless belt conveyor 31A, and through a guide roll 4 which comprises idle rolls 41, the board is further transferred from a vertical conveyor 6, which comprises a pair of driven endless belt conveyors 61 and 62 disposed to be closely confronted each other, onto a bridge conveyor 7 which comprises an elongated, driven endless belt conveyor 71 and which is disposed at an upper part 1002 of the bridge 100. Then, the board a is conveyed to a double facer (not shown in the drawings) by way of a device for guiding board 8, a tension-imparting device 101, a pre-heater 102 and a glue machine 103.

On the other hand, a single-faced corrugated board b produced by a single facer SB is fed by means of a vertical conveyor 1B, which comprises a pair of driven endless belt conveyors 11B and 12B disposed to be closely confronted each other, onto a bridge conveyor 2B which comprises an elongated, driven endless belt conveyor 21B and which is disposed at the lower bridge part 1001 of the bridge 100. After passing through a feed conveyor 3B which comprises driven endless belt conveyors 31B and 32B, the guide roll 4 comprising the idle rolls 41 and the bridge conveyor 7 the board is further conveyed to the double facer in a similar route to the route in the case of the abovementioned single-faced corrugated board a.

The bridge conveyor 2A (or 2B or 7) is operated at a speed ranging from ⅛ to 1/12 of the transporting speed of the vertical conveyor 1A (or 1B or 6). The vertical conveyor 1A (or 1B) is operated at a speed synchronized with the delivering speed of the single facer SA (or SB) for the single-faced corrugated board a (or b). It is also operated at a speed considerably higher than that of the vertical conveyor 6. A stored portion a" (or b") of the single-faced corrugated board a (or b) which looks like waves on the bridge conveyor 7 can be increased by making the feeding speed of the vertical conveyor 6 for the single-faced corrugated board a (or b) higher than the clamping speed of the double facer for the board a (or b), and can be decreased by making the feeding speed lower than the clamping speed. The stored portion can be maintained at a suitable quantity by making both speeds equal to each other. A stored portion a' (or b') of the single-faced corrugated board a (or b) which looks like waves on the bridge conveyor 2A (or 2B) can be increased, decreased or maintained at a suitable quantity by making the feeding speed of the vertical conveyor 1A (or 1B) and the single facer SA (or SB), which operates in synchronism with the vertical conveyor 1A (or 1B), higher than, lower than or equal to the conveying speed of the vertical conveyor 6 respectively, in the same way as in the case of the abovementioned stored portion a" (or b").

Now, a flute-change can be made in the following manner from the single-faced corrugated board a (or b) fed from the single facer SA (or SB) into the double facer to the single-faced corrugated board b (or a) which is about to be produced by the single facer SB (or SA). First, all of the single facer SB (or SA), the vertical conveyor 1B (or 1A) and the bridge conveyor 2B (or 2A) are operated so that the single-faced corrugated board b (or a) fed out from the single facer SB (or SA) is pushed up onto the bridge conveyor 2B (or 2A) at the lower part of bridge 1001 by means of the vertical conveyor 1B (or 1A). Next, the feed conveyor 3B (or 3A) is operated to convey the single faced corrugated board b (or a) until the leading edge of the board reaches the delivery end of the conveyor 3B (or 3A), and then the operation of the conveyor 3B (or 3A) is stopped. On the other hand, the flowing single-faced corrugated board a (or b) is cut on or before the vertical conveyor 1A (or 1B) and then the operation of the single facer SA (or SB) is stopped. When the tailing edge of the single-faced corrugated board a (or b) comes to the entrance or near the entrance of the vertical conveyor 6, the operation of each of the conveyors 6, 3A (or 3B), 2A (or 2B) and 1A (or 1B) is stopped. After the leading edge of the single-faced corrugated board b (or a) is connected with the tailing edge by using an adhesive tape, the conveyor 3B (or 3A) and the conveyor 6 are again operated so as to convey the single-faced corrugated board b (or a) produced by the single facer SB (or SA) to the double facer.

The abovementioned procedure may also be practised in a following manner. Namely, after the flowing single-faced corrugated board a (or b) is cut on the vertical conveyor 6 or before it (on a tool rest 51), the operation of the single facer SA (or SB) is stopped and the tailing edge of the single-faced corrugated board a (or b) is connected with the leading edge of the single-faced corrugated board b (or a) by using an adhesive tape. Thereafter, the conveyor 3B (or 3A) and the conveyor 6 are again operated so that the single-faced corrugated board b (or a) produced by the single facer SB (or SA) is fed to the double facer.

Incidentally, when the single-faced corrugated board a (or b) is roughly cut on or before the vertical conveyor 1A (or 1B), the tailing edge may be cut again to be reformed when it reaches the tool rest 51 and then the reformed tailing edge may be connected with the leading edge.

In the manner described above, the single-faced corrugated board fed to the double facer is flute-changed from the single-faced corrugated board a (or b) to the single-faced corrugated board b (or a). Preferably, the single-faced corrugated board a (or b) is cut at the stored portion a" (or b") or before it and more preferably, at the stored portion a' (or b') or before it. Further preferably the tailing edge of the single-faced corrugated board a (or b) is connected with the leading edge of the single-faced corrugated board b (or a) in or before the stored portion a" (or b"). Since the single facer SB (or SA) starts operating before the single facer SA (or SB) stops operating, it is not necessary to lower the feeding speed of the single-faced corrugated board to the double facer during the flute change. During the flute-change, therefore, it is no longer necessary to carry out such a dangerous work wherein the leading edge of the single-faced corrugated board must be inserted into a gap between a heating plate at the entrance of the double facer and a cotton belt.

Figure 4:
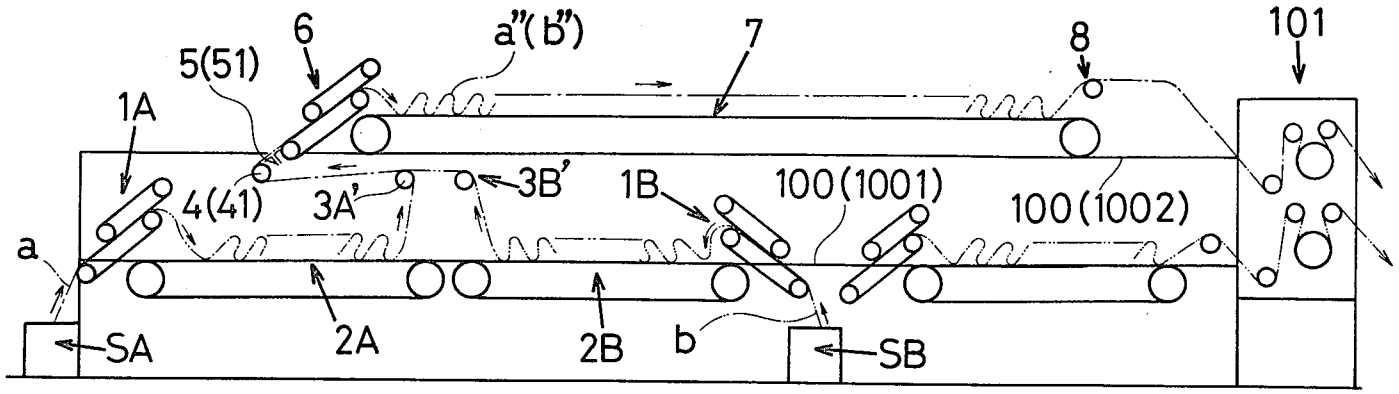
FIG. 4 is a schematic view showing another embodiment of the apparatus used for practising the method of the invention.

FIG. 4 shows another embodiment of the apparatus for practising the method of the present invention. This apparatus is exactly the same as the forementioned apparatus except that feed rolls 3A' and 3B' are employed in place of the feed conveyors 3A and 3B and that the positions of the single facer SB and the vertical conveyor 1B are symmetric each other with respect to the bridge conveyor 2B. Accordingly, detailed description of this apparatus is deleted.

Next, explanation is given as to how a defective portion can be removed if such is found on the single-faced corrugated board which flows on the bridge. A conveyor 9 for removing the defective portion comprises an elongated, driven endless belt conveyor 91 and idle rolls 92 which are disposed at the feed end of the conveyor so as to be closely confronted each other and which are disposed near the transporting surface of the conveyor. An endless conveyor belt which is driven or isn't driven may be used in place of the rolls 92. When the beginning of the defective portion of the single-faced corrugated board reaches the tool rest 51 for cutting, each of the conveyors 3A (or 3B) and 6 is stopped and the board is cut at the beginning of the defective portion. After cutting, the leading edge of the board is clamped by the conveyor 9 so that the defective portion is transferred out of the bridge. When the end of the defective portion reaches the tool rest 52, the board is cut at the end so that the defective portion is removed from the board. Both edges of the boards are then connected and both conveyors 3A (or 3B) and 6 are again operated. The operation of the conveyor 9 is stopped after the defective portion is removed out of the bridge 100. Since both the removal of the defective portion of the single-faced corrugated board a (or b) and the connection of the boards which is done after the removal of the defective portion are carried out between the first stored portion a′ (or b′) and the second stored portion a″ (or b″), it is unnecessary to interrupt the feed of the board into the double facer and the delivery of the boards from the single facers. Also, it is unnecessary to reduce the feeding speed from the single facers to the double facer, and a corrugater can be enabled to operate continuously. The removal of the defective portion can be made simply and safely by less workers. It can be carried out by a method of making the removing conveyor clamp the leading edge of the board with subsequent simple works.

What is claimed is:

1. A method for producing double-faced corrugated boards, which includes a method for changing single-faced corrugated boards, characterized in that said method for changing single-faced corrugated boards comprises the step of:

cutting a single-faced corrugated board, which is fed from a single facer onto a bridge and delivered from the bridge into a double facer, at a position which is located on or before said bridge;

and splicing the tailing edge of the board with the leading edge of another single-faced corrugated board which is fed from another single facer onto said bridge.

2. A method for producing double-faced corrugated boards according to claim 1, wherein a portion of said former single-faced corrugated board, which is fed from said former single facer onto said bridge, is stored on said bridge and said former single-faced corrugated board is cut at a position which is located in or before said stored portion of the board.

3. A method for producing double-faced corrugated boards according to claim 1 or 2, wherein a portion of said former single-faced corrugated board, which is fed from said former single facer, is stored firstly on a lower part of said bridge; another portion of said former single-faced corrugated board is stored secondly on a upper part of said bridge; said former single-faced corrugated board is cut at a position which is located in or before said firstly stored portion; and the tailing edge of said board is spliced with the leading edge of said latter single-faced corrugated board, until said tailing edge comes to a position in which said former corrugated board is secondly stored.

4. A method for producing double-faced corrugated boards according to claim 1 or 2 wherein a method for removing defective portions of single-faced corrugated boards is further included; and said method for removing defective portions of single-faced corrugated boards comprises the steps of:

cutting firstly the former single-faced corrugated board which is fed from the former single facer onto said bridge, and which is delivered into said double facer after a portion of said board is stored on the bridge, when the beginning of a defective portion of said board comes before said stored portion;

guiding the leading edge of said board out of said bridge to deliver said defective portion of the board out of said bridge;

cutting said board secondly when the defective portion of the board is delivered out of the bridge;

and splicing the tail edge of said former corrugated board, which has been formed when the board has been cut firstly, with the leading edge which is formed when the board is cut secondly.

5. A method for producing double-faced corrugated boards according to claim 3, wherein a method for removing defective portions of single-faced corrugated boards is further included; and said method for removing defective portions of single-faced corrugated boards comprises the steps of:

cutting firstly the former single-faced corrugated board which is fed from the former single facer onto said bridge, and which is delivered into said double facer after a portion of said board is stored on the bridge, when the beginning of a defective portion of said board comes before said stored portion;

guiding the leading edge of said board out of said bridge to deliver said defective portion of the board out of said bridge;

cutting said board secondly when the defective portion of the board is delivered out of the bridge;

and splicing the tail edge of said former corrugated board, which has been formed when the board has been cut firstly, with the leading edge which is formed when the board is cut secondly.

* * * * *